US006689027B1

(12) United States Patent
Gardikis, Jr.

(10) Patent No.: US 6,689,027 B1
(45) Date of Patent: Feb. 10, 2004

(54) AUTOMATIC SPOTTING WEIGHT BENCH

(76) Inventor: David Gardikis, Jr., 30 Touhey St., Fall River, MA (US) 02721

( * ) Notice: Subject to any disclaimer, the term of this patent is extended or adjusted under 35 U.S.C. 154(b) by 15 days.

(21) Appl. No.: 09/948,616

(22) Filed: Sep. 7, 2001

Related U.S. Application Data

(60) Provisional application No. 60/230,740, filed on Sep. 7, 2000.

(51) Int. Cl.[7] ..... A63B 26/00
(52) U.S. Cl. ..... 482/142; 482/72
(58) Field of Search ..... 482/142, 148, 482/140, 72

(56) References Cited

U.S. PATENT DOCUMENTS 3,874,658 A 4/1975 Flowers
4,632,390 A * 12/1986 Richey ..... 272/120
5,151,072 A 9/1992 Cone et al.
5,281,193 A 1/1994 Colbo
5,433,687 A 7/1995 Hinzman et al.
5,665,038 A 9/1997 Miller

FOREIGN PATENT DOCUMENTS

GB 2160785 * 1/1986 ..... 482/142

* cited by examiner

*Primary Examiner*—Nicholas D. Lucchesi
*Assistant Examiner*—L Amerson
(74) *Attorney, Agent, or Firm*—Maine & Asmus

(57) ABSTRACT

An automatic spotting weight bench used to support a weight bar and create an escape opening after a failed bench press lift. In one of the embodiments, a foot release mechanism and mechanical knuckle work in conjunction to drop the head end of the weight bench so that the weights are resting on a pair of support bars. In one embodiment, there is a means of controlling the drop of the weight bench so that it is lowered gently.

18 Claims, 5 Drawing Sheets

AUTOMATIC SPOTTING WEIGHT BENCH

RELATED APPLICATIONS

This application claims the benefit of U.S. Provisional Application No. 60/230,740, filed Sep. 7, 2000, and is herein incorporated in its entirety by reference.

BACKGROUND OF THE INVENTION

1. Technical Field of the Invention

The present invention relates to the field of physical exercise equipment, and more particularly to a safer weight bench design.

2. Background of the Invention

Resistance exercises are a form of strength training that stimulates the muscle by requiring a body part to overcome resistance against opposing force. Typically, the body part is challenged by using dumb bells, barbells, and other forms of weights. The goal of the program is to increase the muscle mass, and in bench pressing, the effort is concentrated on the upper body area.

By subjecting the upper body to strength training, a person develops not only muscular strength and endurance, but improved physical appearance and metabolism. This means that a person who exercise regularly not only reduces risks of injuries caused by activities such as heaving lifting but view life with a healthier attitude. Attractive physical appearance is conducive to a fruitful social encounter and successful business life. In addition, for many people, exercise relieves stress that may trigger diseases such as heart attacks and strokes.

While the benefits of strength training are well recognized, not everyone has the time to go to the gym. Or, some just prefer to work out alone or at home. In either case, a safety issue arises when a lifter wants to bench press alone. This is especially true during bench presses when the lifter is positioned on his/her back. As the exhaustion from 30 repetitive cycles sets in, the probability of not being able to lift the weight off the person's chest increases. This is especially true as weights and repetitions are increased to add rigor to the workout. Thus, instead of improving muscle fitness, the lifter becomes subject to serious risks of injury.

To address the concern of lifters who like to workout alone, various contraptions have been designed to prevent the lifter from being pinned under the weight bar after a failed lift. One such device is a platform height adjusting mechanism disclosed in U.S. Pat. No. 5,281,193. A lifter actuates the device when the barbell can no longer be safely lifted from the lifter's chest. The safety device causes a pivotal displacement of the support platform that creates an opening between the lifter and the barbell between from which the lifter now can emerge.

There are numerous other safety devices such as cables that are hooked to pulleys and operate to keep the weights from falling below a certain level. Other methods use support bars to raise the weights off the lifter's chest.

However, none of these other devices address the problem of protecting the lifter from the jarring motion of the safety devise itself. The safety of the prior art devices is questionable, and generally the prior art devices were cumbersome to use and deploy. What is needed is a means for protecting the lifter not only from the barbell weights, but from the impact when the safety device is triggered and the barbell weights are restrained. Such means should be not only be cost effective, but add minimal amount of bulk or weight to the equipment.

SUMMARY OF THE INVENTION

Accordingly, an object of the present invention is to provide a safe environment for an individual involved in bench-pressing weights. The present invention employs several novel features including a mechanical safety device when the operator needs to escape being pinned by the barbell. There is a controlled lowering motion with a mechanical knuckle, and a double safety bar support among other features.

The present invention provides a means of reducing the effects created when the safety mechanism is actuated by the lifter after a failed lift. Spatial disorientation is minimized when the lifter's head drops back simultaneously with the head portion of the bench. Likewise, lifter's back is protected as the head drops below a horizontal plane.

One embodiment of this invention is to provide a conventional weight bench with a tilting means to allow the head portion of the bench to pivot gently as the barbell is secured on a resting member running along the side of the bench. The tilting means is actuated by a foot lever and is attached to the body support pad and the frame. The cushioning effect is accomplished by interconnecting the mechanical knuckle and hydraulic cylinder with a pair of horizontal bars, and with a rubber or neoprene stopper at the end of travel. The frame is also fitted with pins on both ends that are used as resting pads for the weight bar as the body support pad is lowered.

Another object of the invention is to provide motivation to continue with the exercise regiment. Once the lifter becomes secure in knowing that in the event of a failed lift, an escape hatch can be created with a simple action of kicking the foot lever, the lifter's exercise regiment can be increased in order to achieve maximum physical and mental condition. Furthermore, the lifter may become motivated to exercise even when tired or not simply feeling at best.

In comparison to prior art devices, a mechanical safety knuckle that is a safer mechanism when the weights are being pressed. Whereas hydraulic cylinders can fail, the mechanical knuckle does not rely on hydraulics. The mechanical knuckle supports the person ina superior manner when the arms are extended. And, the automatic return also aids in mitigating human error in leaving the device in good working operation.

Yet another object is to provide a safety feature should a cylinder fails as the lifter is in a start position. A cylinder failure at such moment can cause serious injury in that the lifter's arms are locked in fully extended position as the lifter's head pivots with the body support pad. Extensive damage to the equipment and the operator may result in as the weight slams against the support arms. The bars are supported on both ends to increase rigidity and weight capacity of the bars.

One object includes a weight bench assembly with safety features, comprising a bench frame having a first pair of vertical members disposed parallel to a second pair of vertical member, wherein the first and second vertical members are fixedly attached to an elongated base. There are a pair of support elements disposed between the first and second vertical members. A platform with a head end and foot end is pivotally connected to the frame at the foot end, and there is a means for angularly declining the platform.

Another object is the weight bench assembly, wherein the pair of support elements are angularly disposed within the first and second vertical members.

Yet a further object is the weight bench assembly, wherein the means for declining is a knuckle mechanism having three pivoting points for collapsing a unitary support. There is a foot operated lever interconnected to the knuckle mechanism, wherein the foot operated lever actuates the knuckle mechanism. And, a middle pivot point of the knuckle mechanism has an offset center pin. Additionally, the weight bench assembly can further comprise a knuckle brace.

An object includes the weight bench assembly, further comprising a spring for providing tension on the release mechanism. Also, further comprising a shock absorber connected between the horizontal platform and the frame. In addition, the weight bench assembly, further comprising a return spring connected between the horizontal platform and the frame.

An object of the invention is a method for automatic spotting when using a weight bench, comprising the steps of laying on the bench in a substantially horizontal position, bench pressing a set of weights attached to a barbell from the horizontal position, pressing a foot lever when unable to lift the set of weights to a secure position, pivoting a head end of the weight bench, wherein the pivoting drops the head end to a safe position, and securing the set of weights on a pair of support bars.

A final object is a method for automatic spotting when using a weight bench, further comprising the step of returning the weight bench to a substantially horizontal position.

Still other objects and advantages of the present invention will become readily apparent to those skilled in this art from the following detailed description. As will be realized numerous modifications, alterations and adaptations can be made for achieving an integral sheath positioned on the outer surface of a container or cup, without departing from the spirit or the scope of this invention.

BRIEF DESCRIPTION OF THE DRAWINGS

The present invention will be readily understood by the following detailed description in conjunction with the accompanying drawings, wherein like reference numerals designate like structural elements.

DESCRIPTION OF THE PREFERRED EMBODIMENT

Figure 1:
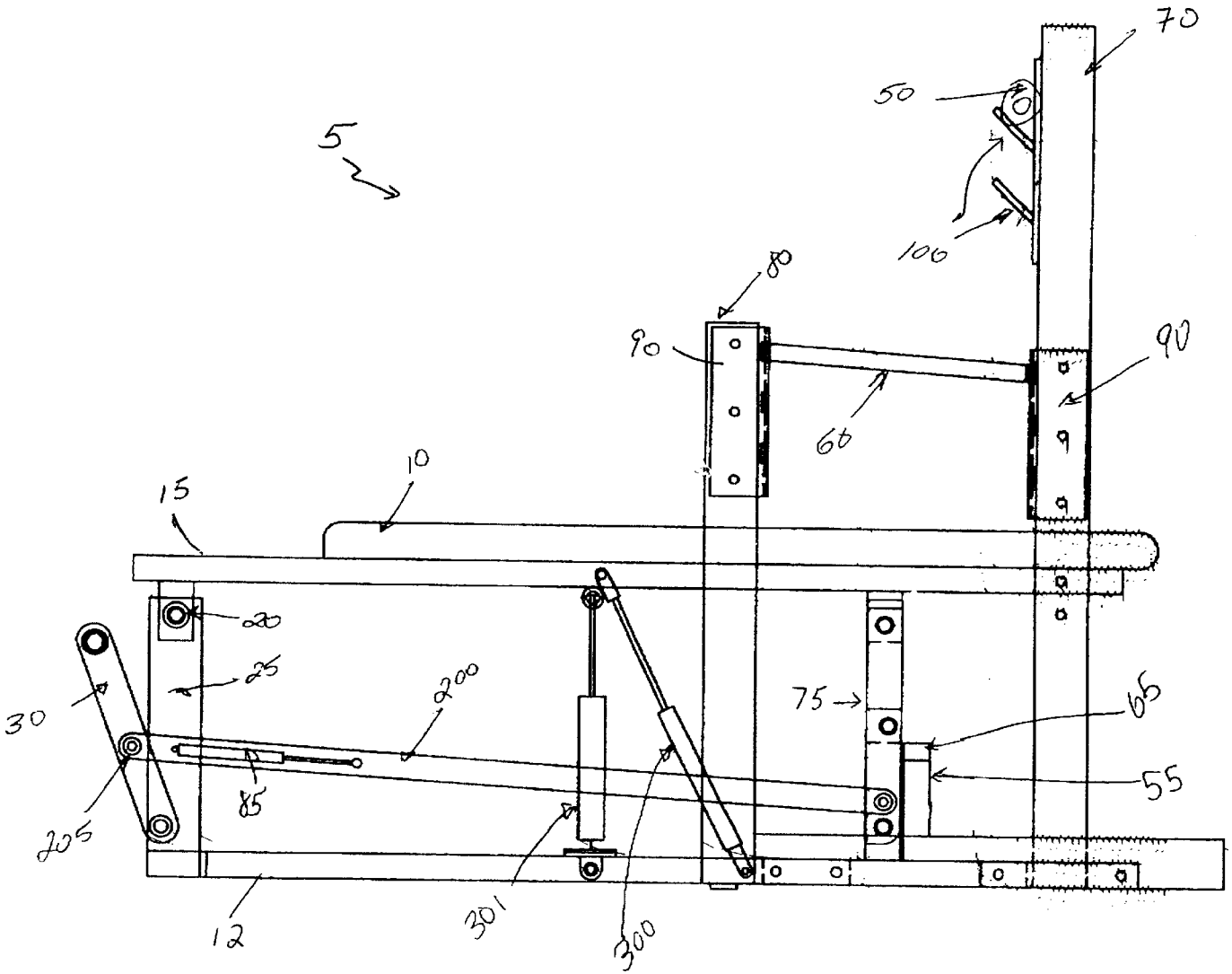
FIG. 1 Automatic Spotting Bench in normal position

As shown in FIG. 1, a weight bench 5 has a support pad 10 with a surface that is cushioned normally for comfort and is mounted to a horizontal support 15. There is a first pair of vertical supports 70 near the head of the bench 5 that is fitted with at least one pair of angled brackets 100 to hold the barbell and weights 50 until the lifter is ready to pump or after the lifter is finished. The height of the pair of first vertical supports 70 conforms to the standard industry accepted height. When there are several brackets 100 mounted on the vertical support 70, the user can select where to place the weights.

There is a second pair of vertical supports 80 located approximately at the midsection of the support pad 10. This set of vertical supports 80 is positioned so as not to interfere with the normal bench pressing operations. A pair of emergency support bars 60 extends between the first pair of vertical supports 70 and the second pair of vertical supports 80. The position of the support bars 60 are adjustable within a series of slotted brackets 90 between the first and second pair of vertical posts 70, 80, so that the bars 60 are at a slight angle toward the head end of the bench to help the weight roll back behind the persons head, thus allowing additional space to exit. Although this is a preferred embodiment of the support bars, it is well within the scope of the invention to have bars approximately parallel to the floor and the weights resting on the substantially horizontal bars.

The emergency support bars 60 are placed into the same corresponding set of holes 90 so that both bars 60 are at the same height on each end. In the preferred embodiment the emergency support bars 60 are a pair of one inch diameter pins that are approximately sixteen inches long and are secured in place by clips. The corresponding holes 90 on the vertical supports 70, 80 are in two inch increments to compensate for the torso and chest differences of the users. The vertical supports 70, 80 are made from 3"×1.5"×⅛" wall tubing in a preferred embodiment.

In operation, the support bars 60 are adjusted so that the bars 60 are two inches below the lowest travel of the barbell and weights 50, which is about two inches above the chest of the user when lying on the pad 10.

Also shown in FIG. 1, is a square bar 55 mounted on the front end of the bench proximate to the mechanical knuckle 75, and situated to keep the knuckle 75 from bending. On the upper portion of the square bar 55 is a rubber stopper 65 upon which the lowered bench rests when lowered.

There is a shock member 301 pivotably connected to between the lower frame 12 and the horizontal support 15 that provides controlled motion of descent In one embodiment a 90/10 hydraulic automotive drag racing shock is used. Also pivotably interconnecting between the horizontal support and the lower frame is a return spring 300. The return mechanism 301 provide sufficient force to return the horizontal support 15 back to the original position with the knuckle 75 engaged. The shock absorber and return mechanism can be interconnected by pivoting connections or via a wheel and track assembly.

One embodiment includes a gas spring 85 that is affixed to the bar 200 on a first end and connected to the vertical foot lever support tube 25 at the second end. The gas spring 85 provides tension on the foot lever release mechanism so that a sufficient force in the proper direction is required to actually activate the drop down safety option. This aids in preventing accidentally engaging the release. Another embodiment replaces the gas spring with a spring extension, wherein the spring extension connects to a retention post and to the bar 200 to accomplish the same desired effect.

Figure 2:
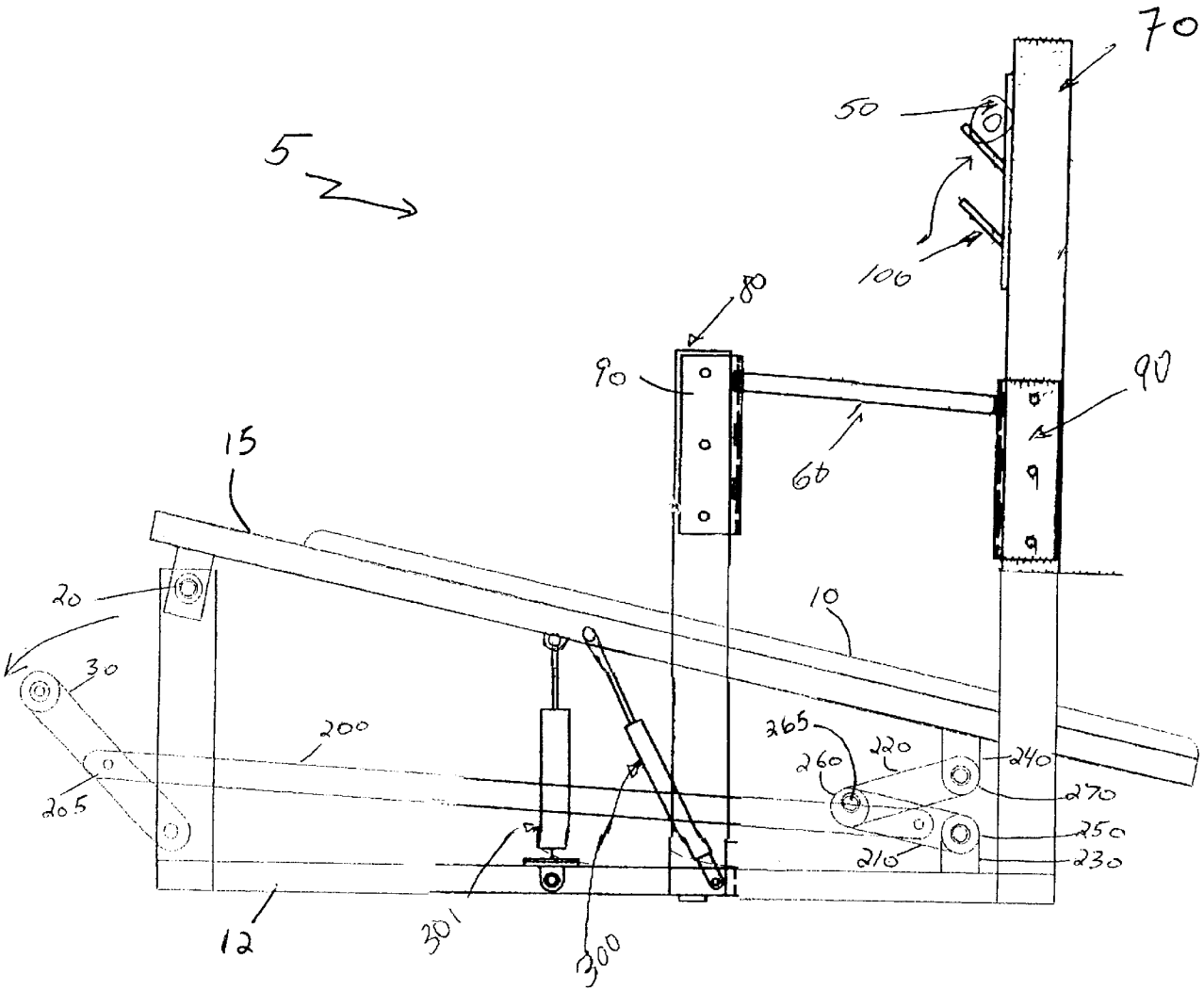
FIG. 2 Automatic Spotting Bench in lowered Position

As illustrated in FIG. 2, the horizontal support 15 with the body support pad 10 is pivotably connected on a pin 20 mounted at the foot end of the bench 5. The horizontal support 15 also interconnects with the knuckle 75 near the head end of the bench 5. In one embodiment, the support pad 10 drops approximately ten inches below the start position so the user can escape from the barbell and weights 50. The barbell and weights 50 are retained by the pair of emergency support bars 60 that extend from the first pair of vertical posts 70 to the second pair of vertical posts 80, permitting about eight inches of space between the user and the barbell and weights 50.

The motion to drop the head section of the support pad 10 is created when a lifter activates a lever 30. A horizontal actuating member 200 is pivotally connected to the foot activated lever 30 at a pivot point 205, which is approximately the mid-section of the foot activated lever 30. The actuating member 200 extends from the foot activated lever 30 to the lower arm 210 of the 3-pivot knuckle 75. The lower arm 210 has a pivot point 250, wherein the pivot point 250 is pivotally connected to a lower vertical member 230 that is fixedly attached to the frame of the bench 12. The actuating member 200 connects to the lower arm 210 at approximately the mid-section of the lower arm 210.

The upper arm of the 3-pivot knuckle 220 rotates at the middle pivot point 260 and is also pivotally connected to an upper vertical member 240 at pivot point 270. In this embodiment the middle pivot point 260 has an offset center pin 265 to aid in keeping the knuckle in the vertical position until the foot-activated release lever 30 is pressed with sufficient force to activate the knuckle 75. The upper vertical member 240 is fixedly attached to the horizontal support 15 on a first end and pivotably connected to the upper pivoting member 220 at the upper pivot point 240. The lower vertical member 230 is fixedly connected to the lower frame 12 on a first end and pivotably connected to the lower pivoting member 21 at the lower pivot point 250.

When the user is unable to safely return the barbell and weights 50 to the angled retaining clips 100, the user can let the barbell and weights 50 fall to the support bars 60. Since the support bars 60 are only slightly lower than the users chest, the user would essentially be trapped. However, by pressing on the foot lever 30, the vertical alignment of the knuckle 75 is broken. This causes the head section of the body support pad 5 to drop creating an opening between the lifter's chest and the weight bar 50.

A hydraulic shock 301 is used to provide a controlled motion that is not jarring to the lifter and minimizes the risks of injury. In one embodiment a 90/10 hydraulic automotive drag racing shock is used.

Once the user is clear of the barbell and weights 50, the user can safely avoid injury or embarrassment. In one embodiment a the nitrogen gas return spring 300 is mounted between the base and the body support platform 15, and returns the platform 15 to the original horizontal position when the user is off the bench. As the knuckle components 220,210 return to their original position, they snap into place and create the solid vertical member as depicted in FIG. 1.

Figure 3:
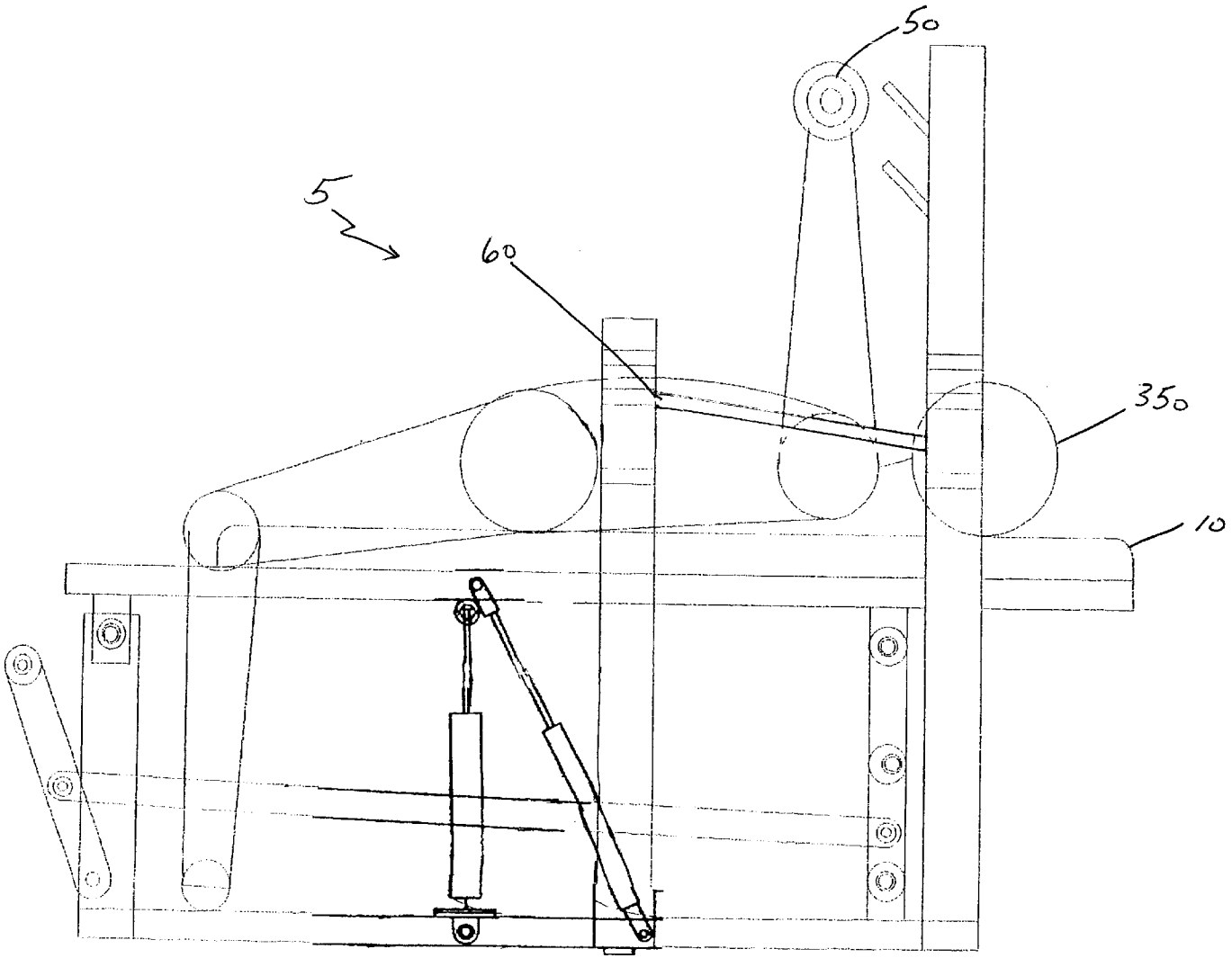
FIG. 3 Start Position with person depicted on bench

In FIG. 3, a person 350 is depicted on the bench 10 in the start position to establish the spatial relationships. The weights 50 are held by the user 350, who has full mobility to press the weights without any interference from the safety mechanisms. This is particularly useful for those that perform serious weight training and prefer to have the weights touch the chest during each repetition. As noted, the bars 60 are slightly below the chest of the user 350 and have no impact on the weight training.

Figure 4:
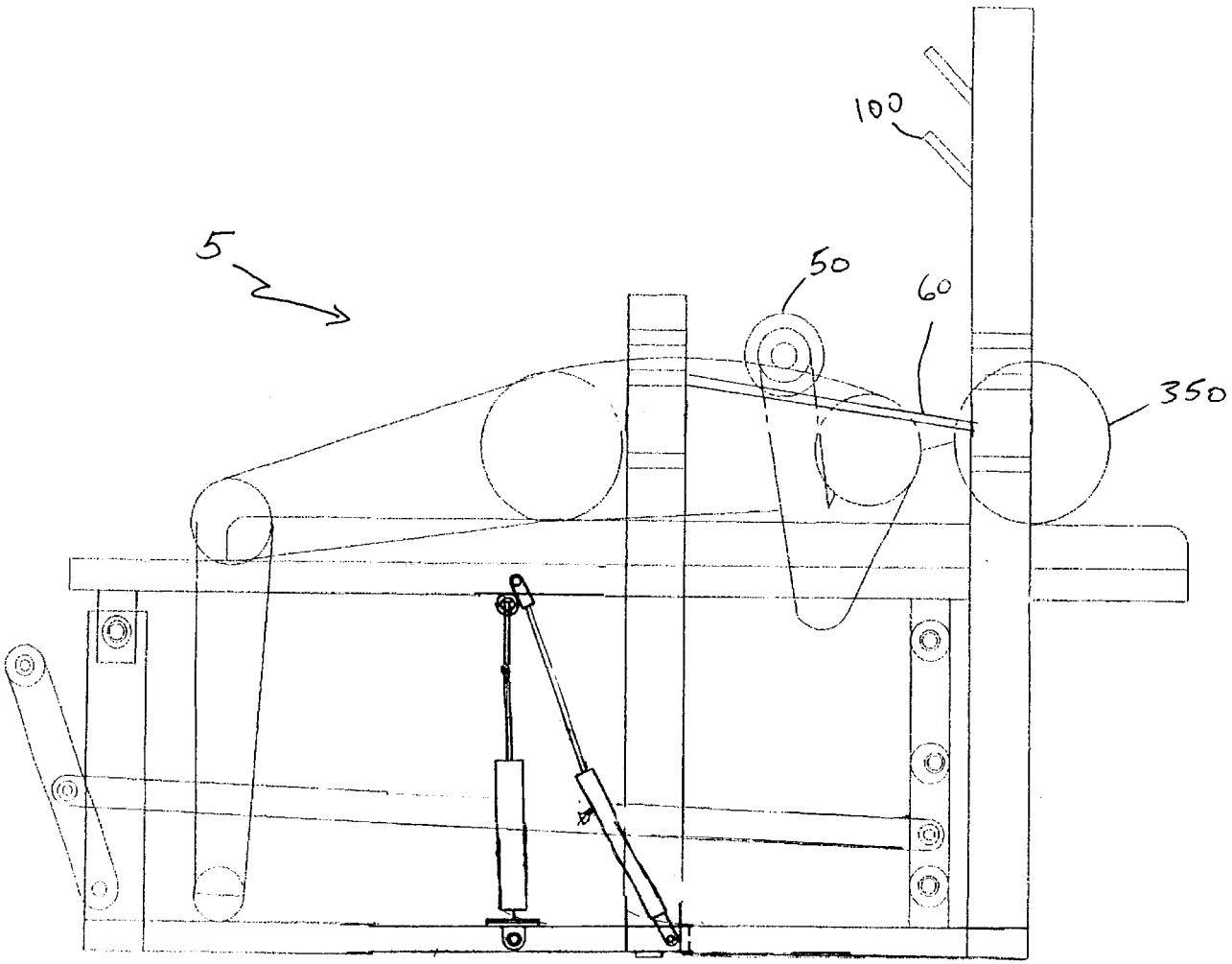
FIG. 4 Stuck position showing person trapped by weights

The 'stuck' position is demonstrated in FIG. 4, wherein the user 350 is unable to press the weights 50 up on the barbell hook 100. The weights 50 are resting on the chest of the user—an unsafe condition. Normally, the user would have to slide out from under the weights or dump the weights off to the side. Both acts carry some risk of injury to the person, equipment, or surroundings.

Figure 5:
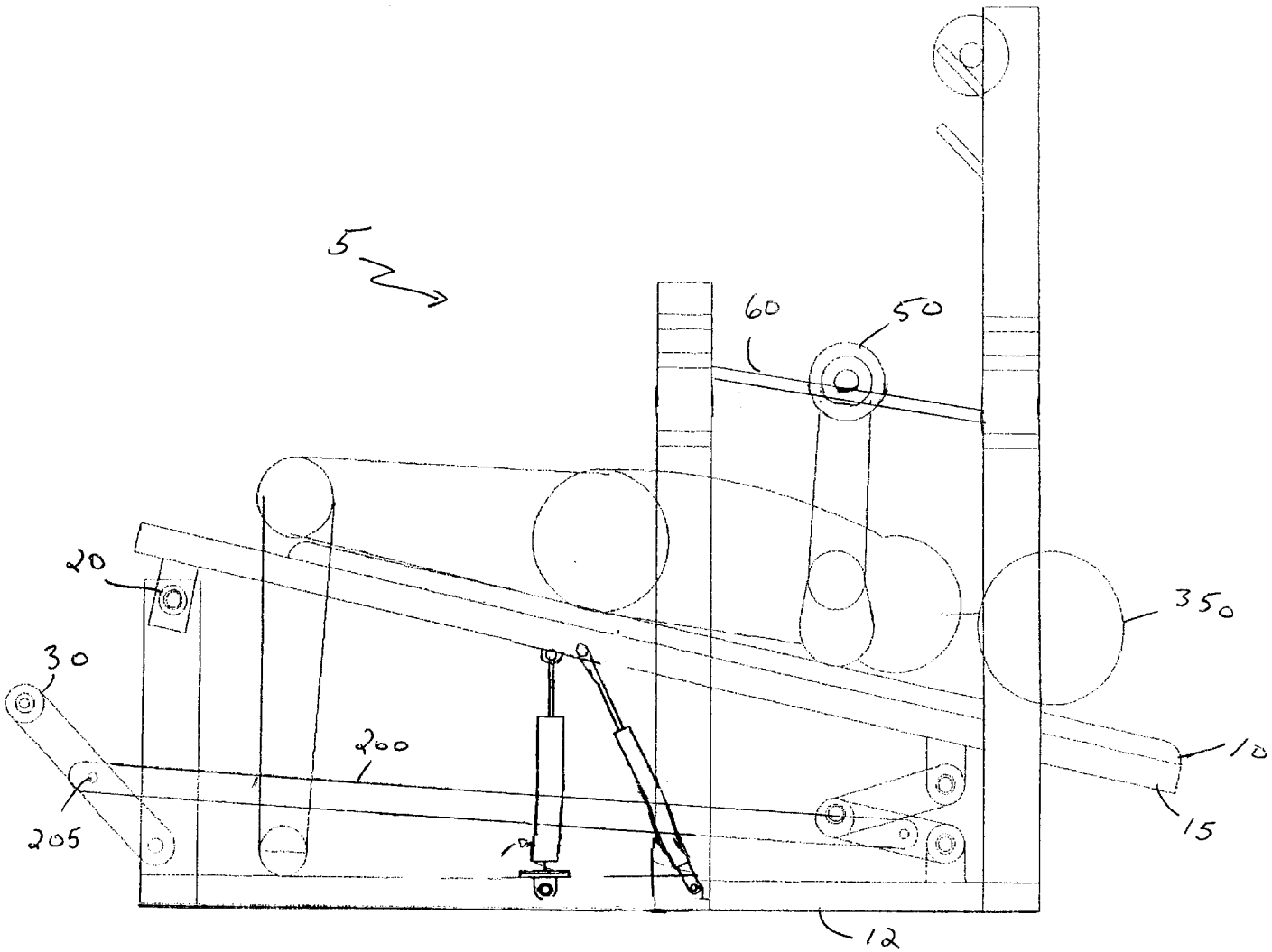
FIG. 5 Escape position showing drop down bench with weights resting on support bars

The escape position is shown in FIG. 5, wherein the weights 50 are safely secured on the bars 60 and the user 350 is lying angularly declined. The user 350 activates the safety position by pressing the safety lever 30 with the user's foot. The activation actuates the knuckle mechanism 75 that declines the bench 10, at the foot end pivot 20. The shock absorber 301 provides a slow downward movement as opposed to a sudden and potentially damaging jarring movement.

The present invention has been particularly shown and described with respect to certain preferred embodiments of features. However, it should be readily apparent to those of ordinary skill in the art that various changes and modifications in form and details may be made without departing from the spirit and scope of the invention. The drawings and description are to be regarded as illustrative in nature, and not as restrictive.

What is claimed is:

1. A weight bench assembly with safety features, comprising:

a bench frame with a head end, a foot end, and a midsection located between said head end and said foot end, having a first pair of vertical members disposed parallel to a second pair of vertical members, wherein said first and second vertical members are fixedly attached substantially perpendicular to an elongated base on a lower end with said pair of first vertical members proximate said head end and said second pair of vertical members proximate said midsection portion;

a pair of support elements disposed between said first and second vertical members, wherein said support bars are disposed between said lower end and an upper end of said first and second vertical members;

a support tube extending substantially perpendicular from said base proximate said foot end;

a platform disposed substantially parallel to said elongated base and extending from said head end to said foot end and located between said lower and upper end, wherein said platform is pivotally connected to said support tube at said foot end; and a means for angularly declining said platform, said means for angularly declining said platform comprising a knuckle mechanism having three pivoting points for collapsing a unitary support.

2. The weight bench assembly according to claim 1, wherein said pair of support elements are angularly disposed within said first and second vertical members.

3. The weight bench assembly according to claim 1, further comprising a foot operated lever interconnected to said knuckle mechanism, wherein said foot operated lever actuates said knuckle mechanism.

4. The weight bench assembly according to claim 1, wherein a middle pivot point of said knuckle mechanism has an offset center pin.

5. The weight bench assembly according to claim 1, further comprising a spring for providing tension on a release mechanism.

6. The weight bench assembly according to claim 1, further comprising a knuckle brace.

7. The weight bench assembly according to claim 1, further comprising a shock absorber connected between said horizontal platform and said frame.

8. The weight bench assembly according to claim 1, further comprising a return spring connected between said horizontal platform and said frame.

9. A method for automatic spotting when using a weight bench, comprising the steps of:

laying on said bench in a substantially horizontal position;

bench pressing a set of weights attached to a barbell from said horizontal position;

pressing a foot lever when unable to lift said set of weights to a secure position;

pivoting a head end of said weight bench, wherein said pivoting drops said head end to a safe position; and securing said set of weights on a pair of support bars.

10. The method for automatic spotting according to claim 9, further comprising the step of returning said weight bench to a substantially horizontal position.

11. A weight bench for safely lifting barbell weights, comprising:

a horizontal support, wherein said horizontal support has a head end, a midsection, and a foot end;

a lower frame having an elongated horizontal base;

a first pair of vertical posts extending substantially perpendicular from said lower frame about the head end;

a second pair of vertical posts extending approximately perpendicular from said lower frame about the midsection;

a pair of emergency support bars, wherein each said bar is disposed between said first and second vertical members;

a support tube at said foot end, wherein said platform is pivotally connected to said frame at said foot; and a foot operated lever controlling said collapsible unitary support a collapsible unitary support extending substantially perpendicular from said base and coupled to said horizontal support.

12. The weight bench according to claim 11, wherein said pair of emergency support elements are angularly disposed.

13. The weight bench according to claim 11, wherein said collapsible unitary support comprises a knuckle mechanism having free pivoting points.

14. The weight bench according to claim 13, wherein a middle pivot point of said knuckle mechanism has an offset center pin.

15. The weight bench according to claim 11, further comprising a spring disposed between said frame and said horizontal support.

16. The weight bench according to claim 11, further comprising a knuckle brace.

17. The weight bench according to claim 11, further comprising a shock absorber coupled between said horizontal platform and said frame.

18. The weight bench according to claim 11, further comprising a return spring connected between said horizontal platform and said frame.

* * * * *